US008439156B1

(12) United States Patent
Abram

(10) Patent No.: US 8,439,156 B1
(45) Date of Patent: May 14, 2013

(54) MUFFLER WITH CONTROLLED PRESSURE RELEASE

(75) Inventor: Kwin Abram, Columbus, IN (US)

(73) Assignee: Faurecia Emissions Control Technologies, Columbus, IN (US)

( * ) Notice: Subject to any disclaimer, the term of this patent is extended or adjusted under 35 U.S.C. 154(b) by 0 days.

(21) Appl. No.: 13/360,744

(22) Filed: Jan. 29, 2012

(51) Int. Cl.
*F01N 1/16* (2006.01)

(52) U.S. Cl.
USPC ..... 181/237; 181/212; 181/227; 181/228

(58) Field of Classification Search ..... 181/237, 181/212, 227, 228
See application file for complete search history.

(56) References Cited

U.S. PATENT DOCUMENTS

| | | | | |
|---|---|---|---|---|
| 4,903,486 | A * | 2/1990 | Finkle | 60/324 |
| 4,936,412 | A | 6/1990 | Sala | |
| 6,065,564 | A * | 5/2000 | Uegane | 181/237 |
| 7,066,296 | B2 * | 6/2006 | Uegane et al. | 181/254 |
| 7,591,345 | B1 * | 9/2009 | Goplen et al. | 181/272 |
| 8,047,328 | B1 * | 11/2011 | Milewicz et al. | 181/246 |
| 8,201,660 | B2 * | 6/2012 | Han et al. | 181/254 |
| 2007/0080020 | A1 * | 4/2007 | Emmett | 181/237 |

FOREIGN PATENT DOCUMENTS

| | | | |
|---|---|---|---|
| KR | 20060063082 | A | 6/2006 |
| WO | 2011047852 | A1 | 4/2011 |

* cited by examiner

*Primary Examiner* — Forrest M Phillips

(74) *Attorney, Agent, or Firm* — Carlson Gaskey & Olds

(57) ABSTRACT

A plastic muffler is configured to provide a controlled mode for releasing exhaust gas pressure during an over-pressurization event. The plastic muffler has a plastic casing that includes at least one pressure relief feature. The pressure relief feature allows exhaust gas to escape from the plastic casing when internal exhaust gas pressure exceeds a predetermined pressure level.

26 Claims, 5 Drawing Sheets

MUFFLER WITH CONTROLLED PRESSURE RELEASE

TECHNICAL FIELD

The subject invention relates to a plastic muffler for a vehicle exhaust system, and more specifically relates to a plastic muffler configured to have a controlled failure mode for releasing pressure during an over-pressurization event.

BACKGROUND OF THE INVENTION

Mufflers are used to reduce noise generated by vehicle exhaust systems. Typically, mufflers are made from metal materials, such as stainless steel for example, that can withstand high temperature environments. Metal mufflers are also very structurally robust and can withstand high internal exhaust gas pressures. However, using metal mufflers is disadvantageous from a cost and weight perspective.

A muffler made from a plastic material offers the advantage of being light- weight and more cost effective. However, if internal exhaust gas pressures are excessive, such as when a tailpipe gets plugged for example, the muffler can burst, which is undesirable.

SUMMARY OF THE INVENTION

A plastic muffler is configured to provide a controlled pressure release of exhaust gas. The plastic muffler has a plastic body that includes at least one pressure relief feature. The pressure relief feature allows exhaust gas to escape from the plastic body when internal exhaust gas pressure exceeds a predetermined pressure level.

In one example, the at least one pressure relief feature is formed within in a bottom wall portion of the plastic body.

In another example, the at least one pressure relief valve is formed as an intentionally weakened portion of the plastic body. The intentionally weakened portion is permanently broken the when exhaust gas pressure exceeds the predetermined pressure level.

In another example, the at least one pressure relief feature comprises a movable member. The movable member is moved from a non-failure position to a failure position when exhaust gas pressure exceeds the predetermined pressure level. The movable member is returned from the failure position to the non-failure position when exhaust gas pressure falls below the predetermined pressure level.

In one example, the plastic body includes a drain hole to drain condensate from the plastic body. The drain hole can be integrated with, or separate from, the pressure relief feature.

DETAILED DESCRIPTION

Figure 1:
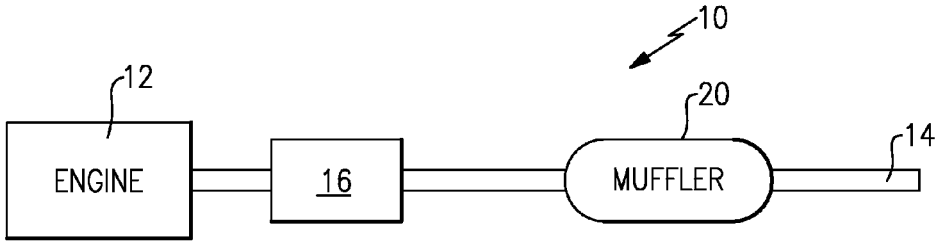
FIG. 1 is a schematic view of a vehicle exhaust system.

FIG. 1 is a schematic view of a vehicle exhaust system 10 that directs exhaust gas generated by an engine 12 to an outlet via a tailpipe 14. The exhaust system 10 can include a variety of exhaust components 16, such as converters, filters, catalysts, etc., that are used to reduce the amount of pollutants that escape from the exhaust gas into the atmosphere. The exhaust system 10 also includes at least one muffler 20 that is used to reduce noise generated by the exhaust system 10. The muffler 20 is located upstream of the tailpipe 14 at a position that is underneath a passenger compartment 22 of a vehicle 24 (see FIG. 2).

The muffler 20 is substantially formed from a plastic material. One example of such a muffler is found in WO 2011/047852, which is assigned to the same assignee as is the subject invention, and which is herein incorporated by reference.

Figure 2:
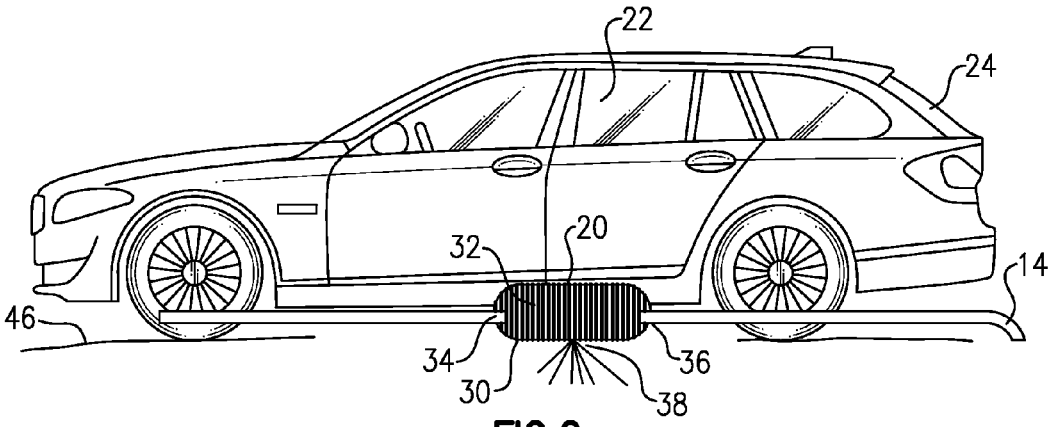
FIG. 2 is a schematic view of a muffler from the exhaust system of FIG. 1 positioned underneath a vehicle.

The muffler 20 comprises a plastic body 30 defining an internal cavity 32 having at least one inlet 34 and at least one outlet 36 such that an exhaust gas flow path is provided between the inlet 34 and the outlet 36. At least one pressure relief feature, schematically indicated at 38 in FIG. 2, is provided within the plastic body 30 that allows exhaust gas to leak out of the plastic body 30 when exhaust gas pressure within the internal cavity 32 exceeds a predetermined pressure level. For example, if the tailpipe 14 becomes at least partially blocked or completely plugged, backpressure within the exhaust system 10 will increase. This will cause pressure within the internal cavity 32 of the muffler 20 to significantly increase. Once this pressure exceeds a predetermined pressure level, the pressure relief feature 38 will allow exhaust gas to leak out of the muffler 20 in a safe manner. This will avoid having the muffler burst open in an undesirable manner.

Figure 3:
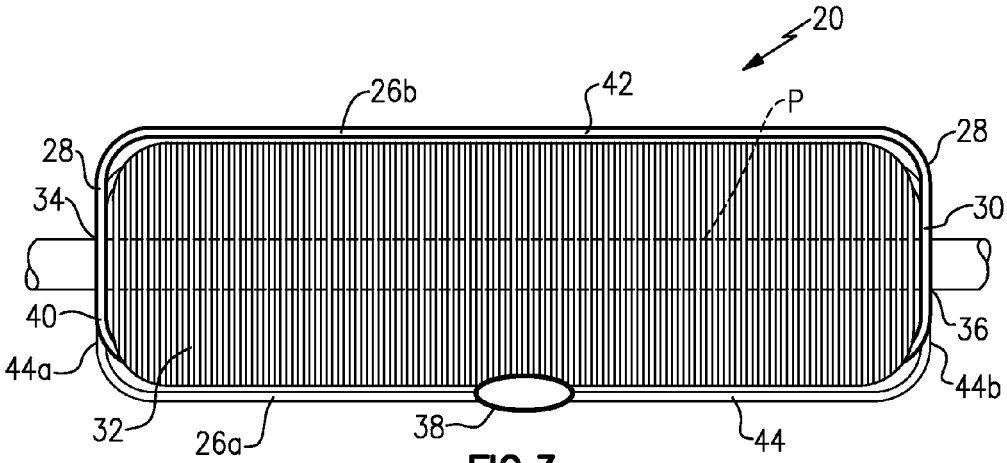
FIG. 3 is a schematic cross-sectional view of a muffler showing a desired location for a pressure relief feature.

The pressure relief feature 38 can take various forms. In the example shown in FIG. 3, the plastic body 30 of the muffler 20 is formed an outer casing or housing 40 comprised of a bottom wall 26*a*, a top wall 26*b*, and a plurality of side walls 28 connecting the top and bottom walls to form the internal cavity 32. Thus, the outer muffler casing 40 includes an upper portion 42 configured to face an underside of the vehicle 24 and a lower portion 44 configured to face a ground surface 46 (FIG. 2). The lower portion 44 is formed from the bottom wall 26*a* and lower portions of the side walls 28. The muffler can be a single piece structure or can be made from multiple pieces, such as an upper shell and lower shell, for example. Further, the muffler 20 may include one or more internal pipes P that may or may not include perforated portions.

The pressure relief feature 38 is formed within the lower portion 44. This allows escaping exhaust gases to be directed generally toward the ground surface 46 and safely away from the passenger compartment 22. The pressure relief feature 38 can be formed anywhere within the lower portion 44 from an upstream end 44*a* to a downstream end 44*b* of the lower portion.

Figure 4A:
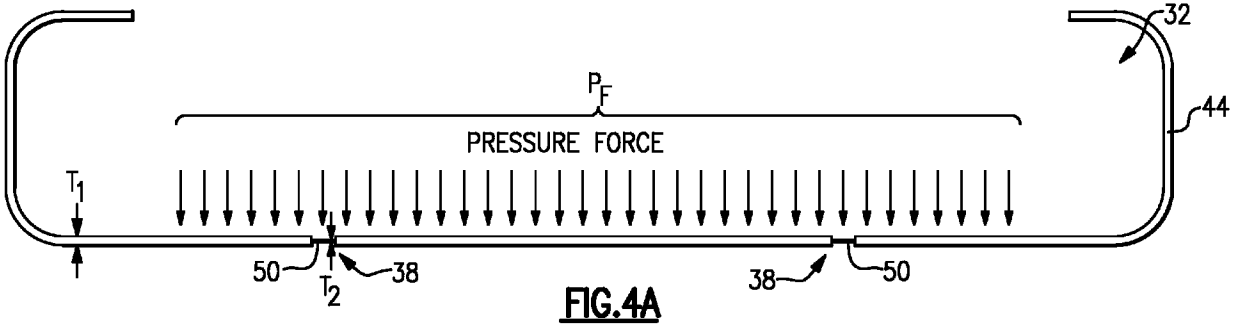
FIG. 4A is one example of a pressure relief feature in a non-failure position.
Figure 4B:
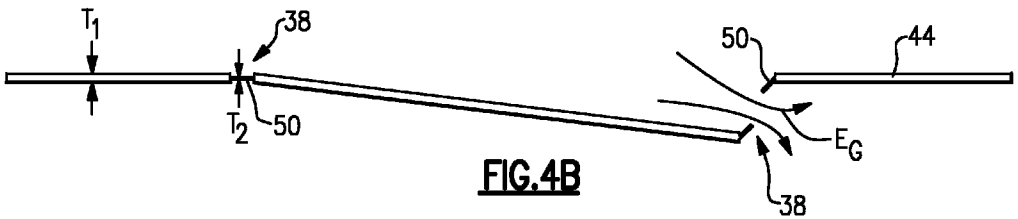
FIG. 4B is the pressure relief feature of FIG. 4A in a failure position.

In the example shown in FIGS. 4A and 4B, the pressure relief feature 38 comprises one or more reduced thickness portions 50 of the lower portion 44 of the plastic body 30. The lower portion 44 has a first thickness T1 for a substantial majority of the lower portion 44. At the reduced thickness portions 50, the lower portion 44 has a second thickness T2 that is less than the first thickness T1 . These portions are formed using a controlled thinning of plastic material during formation of the lower portion 44 of the muffler 20. Thus, the pressure relief feature 38 in this example comprises an intentionally weakened portion of the plastic body 30.

As pressure forces $P_F$ build within the internal cavity, intentional high stress points are formed at the reduced thickness portions 50. When pressure at these portions exceeds a predetermined pressure level, at least one of these portions 50 will break as shown in FIG. 4B, which allows the exhaust gas $E_G$ to leak out in a controlled and safe manner. When the portion 50 breaks, one portion of the lower portion 44 will separate or provide an opening relative to another portion of the lower portion 44 to create an open gap. In this configuration, the pressure relief feature 38 is a one-time failure feature where the portion 50 remains permanently "broken" or open even after pressure levels fall within an acceptable pressure level range.

Figure 5A:
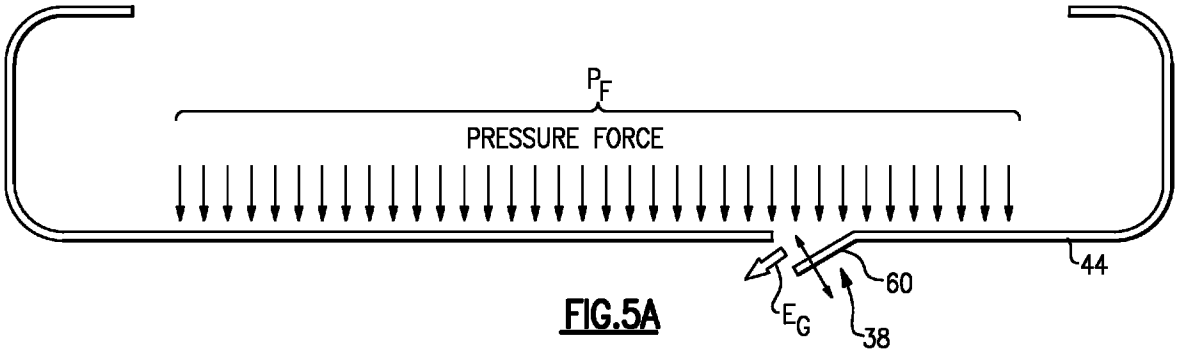
FIG. 5A is another example of a pressure relief feature in a failure position.
Figure 5B:
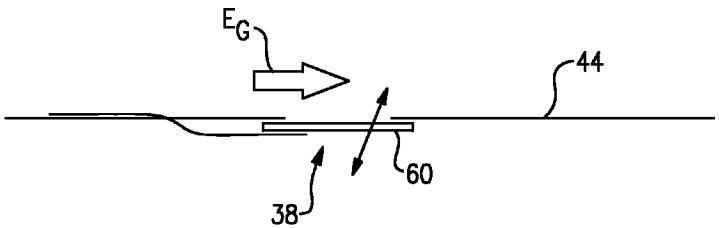
FIG. 5B is the pressure relief feature of FIG. 5A returned to the non- failure position.

FIGS. 5A-5B show a different configuration for a pressure relief feature 38 where the muffler can return to closed condition once pressure levels return to an acceptable pressure range. In this example, pressure relief feature 38 in the lower portion 44 comprises a pressure driven relief device 60 that is movable between an initial, non-failure position, i.e. a closed position (FIG. 5B), where exhaust gas $E_G$ is prevented from leaking from the muffler 20 and a failure position, i.e. an open position (FIG. 5A), where exhaust gas $E_G$ is allowed to leak from the muffler 20 in a controlled and safe manner.

Figure 6:
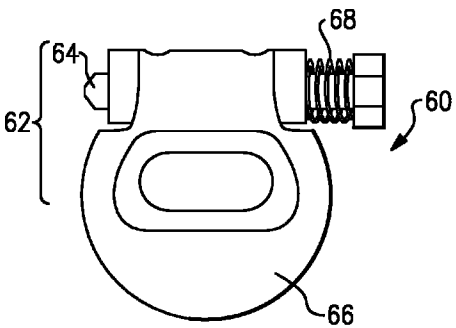
FIG. 6 is one example of a pressure relief feature that can be used in the configuration set forth in FIGS. 5A-5B.

In one example, the pressure driven relief device 60 comprises a valve 62 that is resiliently biased to the closed position. An example of such a valve 62 is shown in FIG. 6. In this example, the valve 62 includes a shaft 64 configured to be mounted within the lower portion 44 and a flapper vane 66 mounted for pivoting movement relative to the shaft 64. A spring 68 biases the vane 66 to a closed position. When pressure forces $P_F$ exceed the predetermined pressure level, the force overcomes the biasing force of the spring 68 allowing the vane 66 to pivot to the open position to allow the exhaust gas to leak out. When the pressure level returns to an acceptable level, the spring 68 will return the vane 66 to the closed position. The advantage with this configuration over the previous configuration is that the muffler does not need to be replaced after a pressure relief event.

It is also desirable to provide a method and structure for draining condensate from the plastic muffler. Providing a drain hole 70 (see FIG. 7) in such a muffler 20 is challenging because the drain hole 70 would also provide an escape path for exhaust gas under high pressure conditions. As such, the escaping gas may be at a temperature that is above the melting temperature of the plastic material used to form the muffler.

Figure 7:
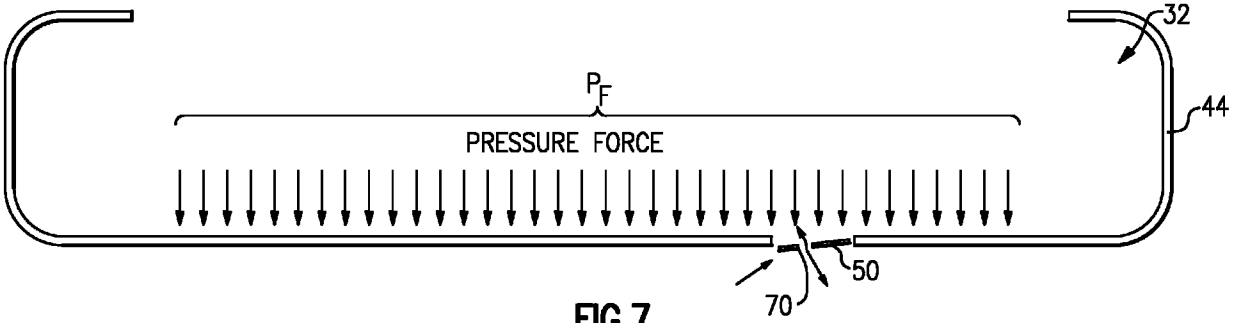
FIG. 7 is one example of a drain feature formed within the muffler.

FIG. 7 shows a configuration similar to FIGS. 4A-4B where the muffler includes reduced thickness portions 50. In this example, the drain hole 70 is formed within the reduced thickness portion 50 to allow condensate to drain out of the muffler 20, i.e. the drain hole is integrated with the pressure relief feature. As this configuration is a one-time failure configuration, if the escaping gas exceeds the melting temperature of the plastic material the potentially damaged area would already be at the failure location.

Figure 8:
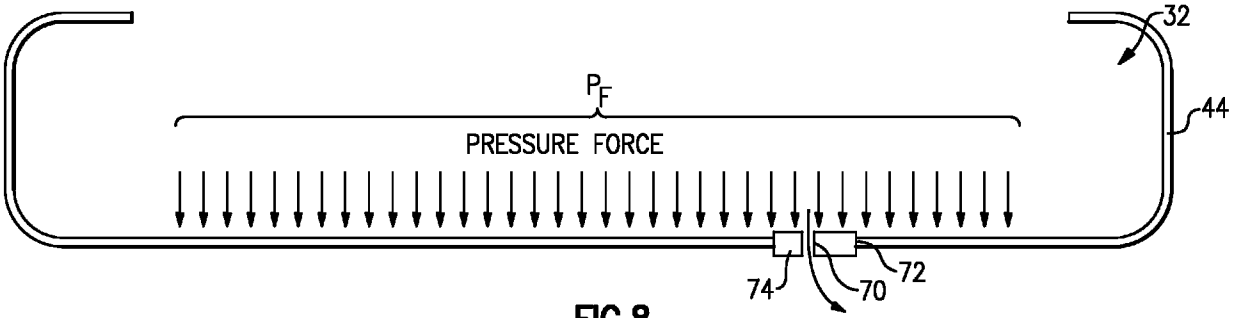
FIG. 8 is another example of a drain feature.

Optionally, as shown in FIG. 8, the drain hole 70 can be formed as a separate feature apart from the pressure relief feature. In this configuration, the lower portion can include an opening 72 that receives a component 74 that is formed from a high temperature material, i.e. formed from a material that has a higher melting point than the plastic material forming the muffler. In one example, a stainless steel material is utilized; however, other high temperature materials could also be used. In one example, the component 74 comprises an insert that is fixed within the opening and the drain hole 70 is formed within the insert. The component 74 can be positioned at any bottom wall location within the lower portion 44. Further, a pressure relief feature, such as those discussed above, could also be added to the configuration shown in FIG. 8.

Figure 9:
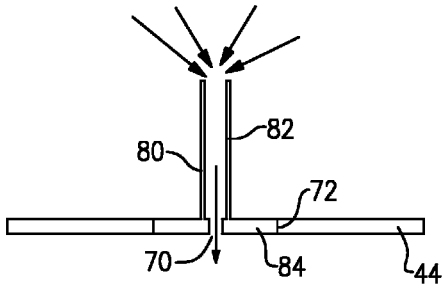
FIG. 9 is another example of a drain feature.
Figure 10:
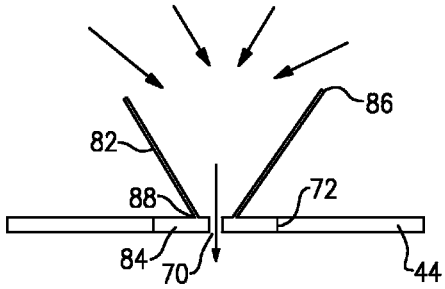
FIG. 10 is another example of a drain feature.
Figure 11:
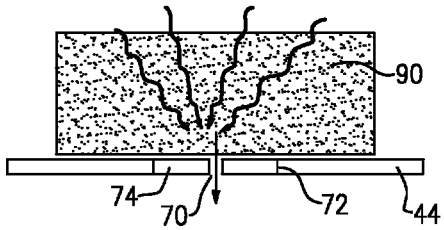
FIG. 11 is another example of a drain feature.

FIGS. 9-11 show other examples of drain holes 70 that can be used either alone or in conjunction with a pressure relief feature 38. FIG. 9 shows an example where the lower portion 44 of the muffler 20 includes a component 80 formed from a high temperature material such as stainless steel, for example. The component 80 comprises a stand-off tube/shield component that includes a tubular portion 82 with an end mount portion 84 that is fixed to the lower portion 44. The drain hole 70 is formed within the end mount portion 84. The tubular portion 82 extends axially away from a bottom surface of the muffler with condensate and/or escaping exhaust gases entering the tubular portion and exiting the drain hole.

FIG. 10 is similar to FIG. 9 but the tubular portion has a conical shape. An upper end 86 of the tubular portion 82 has a wider opening than a lower end 88 of the tubular portion.

FIG. 11 includes a configuration where a pack 90 of fibrous material 90 is positioned over the opening 72 in the lower portion. The pack 90 can be comprised of a single- piece mat or disc of material, or loose material could be used to form the pack. A component such as that shown in FIG. 8, i.e. component 74 is mounted within the opening 72 of the lower portion 44. The pack 90 is positioned to overlap at lease the component 74 and a portion of the lower portion 44 that surrounds the component 74. Condensate flows through the pack and out the drain hole. Thus, there is diffusion and thermal protection provided by flowing through the pack.

A method of controlling a failure mode for a plastic muffler 20 comprises the following steps. A plastic body 30 is provided with an internal cavity 32 that defines an exhaust gas flow path from an inlet 34 to an outlet 36. At least one pressure relief feature 38 is associated within the plastic body 30. A failure of the plastic muffler 20 is controlled by leaking exhaust gas through the pressure relief feature 38 when exhaust gas pressure exceeds a predetermined pressure level.

An additional method step includes forming the pressure relief feature 38 in a bottom portion 44 of the plastic body.

In one example, the method includes forming the pressure relief valve as an intentionally weakened portion 50 of the plastic body, and permanently breaking the intentionally weakened portion 50 when exhaust gas pressure exceeds the predetermined pressure level.

In another example, the pressure relief feature comprises 38 a movable member 60, and the method includes moving the movable member 60 from a non-failure position to a failure position when exhaust gas pressure exceeds the predetermined pressure level, and returning the movable member 60 from failure position to the non-failure position when exhaust gas pressure falls below the predetermined pressure level.

In another example, the method includes forming at least one drain hole 70 in the plastic body. The muffler can only include one of the drain hole or the pressure relief feature. Or, the muffler could include both the drain hole and the pressure relief feature.

The exhaust system described above provides an optimal location for exhaust gas flow in the event that the tailpipe of an exhaust system fails when using a plastic muffler. By providing an intentional path for the exhaust gas to escape, overpressurization is avoided. Further, the configuration set forth above provides the additional benefit of a drain hole that is resistant to hot gas flow.

Although an embodiment embodiment of this invention has been disclosed, a worker of ordinary skill in this art would recognize that certain modifications would come within the scope of this invention. For that reason, the following claims should be studied to determine the true scope and content of this invention.

The invention claimed is:

1. A muffler for a vehicle exhaust system comprising: a plastic body defining an internal cavity having at least one inlet and at least one outlet such that an exhaust gas flow path is provided between said inlet and said outlet; and at least one pressure relief feature formed on said plastic body that allows exhaust gas to leak out of said plastic body when exhaust gas pressure within said internal cavity exceeds a predetermined pressure level.

2. The muffler according to claim 1 wherein said plastic body comprises an outer muffler casing that includes an upper portion configured to face an underside of a vehicle and a lower portion configured to face a ground surface, and wherein said at least one pressure relief feature is formed within said lower portion.

3. The muffler according to claim 1 wherein said at least one pressure relief feature comprises a reduced thickness portion of said plastic body.

4. The muffler according to claim 3 wherein said plastic body comprises a wall that encloses said internal cavity, and wherein said wall is defined by a first thickness, said at least one pressure relief feature comprising a portion of said wall that is defined by a second thickness that is less than the first thickness.

5. The muffler according to claim 4 wherein said portion of said wall permanently breaks when exhaust gas pressure within said internal cavity exceeds said predetermined pressure level.

6. The muffler according to claim 5 wherein said wall is comprised of a bottom wall, a top wall, and a plurality of side walls connecting said top and bottom walls, and wherein said portion of said wall that is defined by said second thickness is located within said bottom wall.

7. The muffler according to claim 1 wherein said at least one pressure relief feature comprises an intentionally weakened portion of said plastic body.

8. The muffler according to claim 1 wherein said at least one pressure relief feature is moveable from an initial, non-failure position to a failure position in response to said exhaust gas pressure within said internal cavity exceeding said predetermined pressure level such that exhaust gas can leak out of said plastic body when in said failure position.

9. The muffler according to claim 8 wherein said at least one pressure relief feature is returnable to said initial, non-failure position once said exhaust gas pressure within said internal cavity falls below said predetermined pressure level such that exhaust gas can no longer leak out of said plastic body.

10. The muffler according to claim 8 wherein said at least one pressure relief feature comprises a valve that is biased to said non-failure position.

11. The muffler according to claim 1 wherein said plastic body includes at least one drain hole for condensate to drain out of the muffler.

12. The muffler according to claim 11 wherein said drain hole is integrated into said at least one pressure relief feature.

13. The muffler according to claim 11 wherein said drain hole is separate from said at least one pressure relief feature.

14. The muffler according to claim 1 wherein said plastic body comprises an outer muffler casing and wherein said at least one pressure relief feature is provided within said outer muffler casing to leak exhaust gas out of said outer muffler casing to atmosphere.

15. The muffler according to claim 1 wherein said at least one pressure relief feature leaks exhaust gas out of said plastic body to atmosphere.

16. A method of controlling pressure release for a plastic muffler comprising the steps of: providing a plastic body with an internal cavity that defines an exhaust gas flow path from an inlet to an outlet; forming at least one pressure relief feature on the plastic body; and leaking exhaust gas through the at least one pressure relief feature when exhaust gas pressure exceeds a predetermined pressure level.

17. The method according to claim 16 including forming the at least one pressure relief feature in a bottom wall portion of the plastic body.

18. The method according to claim 16 including forming the at least one pressure relief valve as an intentionally weakened portion of the plastic body, and permanently breaking the intentionally weakened portion when exhaust gas pressure exceeds the predetermined pressure level.

19. The method according to claim 16 wherein the at least one pressure relief feature comprises a movable member, and including moving the movable member from a non-failure position to a failure position when exhaust gas pressure exceeds the predetermined pressure level, and returning the movable member from failure position to the non-failure position when exhaust gas pressure falls below the predetermined pressure level.

20. The method according to claim 16 including forming at least one drain hole in the plastic body.

21. The method according to claim 16 including forming the plastic body as an outer muffler casing and providing the at least one pressure relief feature within the outer muffler casing to leak exhaust gas out of the outer muffler casing to atmosphere.

22. The method according to claim 16 including leaking exhaust gas out of the plastic body to atmosphere via the pressure relief feature.

23. The method according to claim 16 wherein exhaust gas is leaked out from the plastic body when the exhaust gas pressure exceeds the predetermined pressure level within the internal cavity.

24. A muffler for a vehicle exhaust system comprising:

a plastic body defining an internal cavity having at least one inlet and at least one outlet such that an exhaust gas flow path is provided between said inlet and said outlet, and wherein said plastic body includes an opening formed within a bottom portion of said plastic body;

an insert mounted within said opening, said insert having a higher melting temperature than said plastic body; and at least one drain hole provided within said insert that allows condensate to drain out of said plastic body.

25. The muffler according to claim 24 wherein said plastic body is comprised of a plastic material having a melting point, and wherein said insert is comprised of a material having a higher melting point than the melting point of the plastic material, and wherein said insert is directly fixed to said plastic body.

26. The muffler according to claim 24 including fibrous material located with said internal cavity and covering said drain hole.

* * * * *